US005088199A

United States Patent [19]

Romani

[11] Patent Number: 5,088,199

[45] Date of Patent: Feb. 18, 1992

[54] VARIABLE VACUUM ATTACHMENT FOR HAIR GROOMING CLIPPERS

[75] Inventor: R. Marlene Romani, Indiana, Pa.

[73] Assignee: MDC Romani Inc., Indiana, Pa.

[21] Appl. No.: 554,619

[22] Filed: Jul. 18, 1990

[51] Int. Cl.[5] ..... B25F 3/00; B26B 11/00

[52] U.S. Cl. ..... 30/133; 30/132

[58] Field of Search ..... 30/123, 124, 132, 133; 15/300 R

[56] References Cited

U.S. PATENT DOCUMENTS

| | | | |
|---|---|---|---|
| 2,653,380 | 9/1953 | Atha | 30/133 |
| 2,748,472 | 6/1956 | Sheley et al. | 30/133 |
| 3,073,026 | 1/1963 | Schardler | 30/133 |
| 3,217,407 | 11/1965 | Azar | 30/133 |
| 3,280,456 | 10/1966 | Erickson et al. | 30/133 |
| 3,295,200 | 1/1967 | Padgett et al. | 30/133 |
| 3,331,130 | 7/1967 | Ligon | 30/133 |
| 3,348,308 | 10/1967 | Andis | 30/133 |
| 3,368,277 | 2/1968 | Ve-Vea | 30/133 |
| 3,383,765 | 5/1968 | Meltzer | 30/133 |
| 3,384,919 | 5/1968 | Jording et al. | 15/339 |
| 3,440,681 | 4/1969 | Huxson et al. | 15/339 |
| 3,797,111 | 3/1974 | Keane | 30/133 |
| 4,843,717 | 7/1989 | Crane | 30/133 |

OTHER PUBLICATIONS

Publication "Clipper-Vac Sales, Inc".

*Primary Examiner*—Douglas D. Watts
*Assistant Examiner*—Paul M. Heyrana, Sr.
*Attorney, Agent, or Firm*—Michael R. Swartz; John R. Flanagan

[57] ABSTRACT

A suction attachment for a hair grooming clipper includes a suction head having a vacuum relief port and a flexible sealing lid for covering the port. The relief port communicates between an internal air flow passage in the suction head and the exterior of the suction head. The sealing lid is movable by a user's finger to regulate the degree of relief of the vacuum provided by the port. The suction head has a flow constriction defined in the air flow passage midway between a front inlet and a rear outlet and proximate the location of the relief port such that regulation of vacuum relief occurs at the region of the passage where the air pressure is highest and air velocity is lowest. Also, a hollow tubular extension at one end can be inserted in the relief port when the port is completely open to prevent clogging of the open port by hair entering the port from the exterior of the suction head.

12 Claims, 3 Drawing Sheets

VARIABLE VACUUM ATTACHMENT FOR HAIR GROOMING CLIPPERS

BACKGROUND OF THE INVENTION

1. Field of the Invention

The present invention relates generally to hair grooming clipper attachments and, more particularly, is concerned with improvements to the vacuum or suction attachment for hair grooming clippers.

2. Description of the Prior Art

One of the main concerns of a professional dog groomer is the breathing of fine dog hair and dander into the lungs. This can be a serious problem, as hair does not dissolve—it accumulates. This can cause hair balls and hair emphysema. These small sharp hairs can also become embedded into the groomer's skin and must be removed before they enter tissue or the blood stream. The breathing or assimilation of fleas, ticks and their eggs and larva is another major problem. Parasites are very detrimental and destructive to both animals and humans.

To obviate these problems, vacuum systems are often employed with hair grooming clippers. Typically, a suction head is attached to a hand-held clipper adjacent to its cutting head and is connected to one end of a flexible hose. The other end of the hose is connected directly or via an intermediate conduit to a vacuum generating unit for creating a vacuum in the hose. The vacuum condition draws air into the hose through the suction head, entraining hair cuttings in the air flow through the hose to the vacuum generating unit where the hair cuttings are collected, typically, in a container.

While the above-described vacuum systems have generally improved the cleanliness of grooming shops, reduced the potential hazards to grooming personnel from breathing in hair cuttings and other matter, and made grooming easier, a need arises from time to time to make certain improvements which will solve other problems that crop up and improve performance and productivity even further. Problems which have arisen as recognized by the inventor herein relate to inadequate air flow through the suction head and the inability to easily control the amount of vacuum applied by the suction head.

SUMMARY OF THE INVENTION

The present invention provides several features designed to satisfy the aforementioned needs by solving recently recognized problems and improving performance of the suction attachment for hair grooming clippers. One feature of the present invention relates to the provision of a port in the suction head and a flexible sealing flap or lid for covering the port. The port provides communication between an internal air flow passage of the suction head and the exterior of the head. The sealing lid is easily movable by the user's finger to vary the amount of area of the port closed by the lid and thereby regulate the degree of relief of the vacuum being applied through the suction head.

Another feature of the present invention relates to the improved configuration of the internal air flow passage of the suction head. A flow constriction is defined midway through the air flow passage between the opposite entrance and exit ends thereof and proximate the location of the relief port such that regulation of relief of the vacuum at the port of the suction head occurs at the region of the internal passage where the air pressure is highest and air velocity is lowest.

Still another feature of the present invention relates to the provision of a hollow extension on the relief port such that when the port is completely open it will not become clogged by long hair entering the port from the exterior of the suction head. The hollow extension is preferably in the form of a flexible plastic tube which can be forcibly inserted at one end into the port and retained therein merely by a friction fit.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
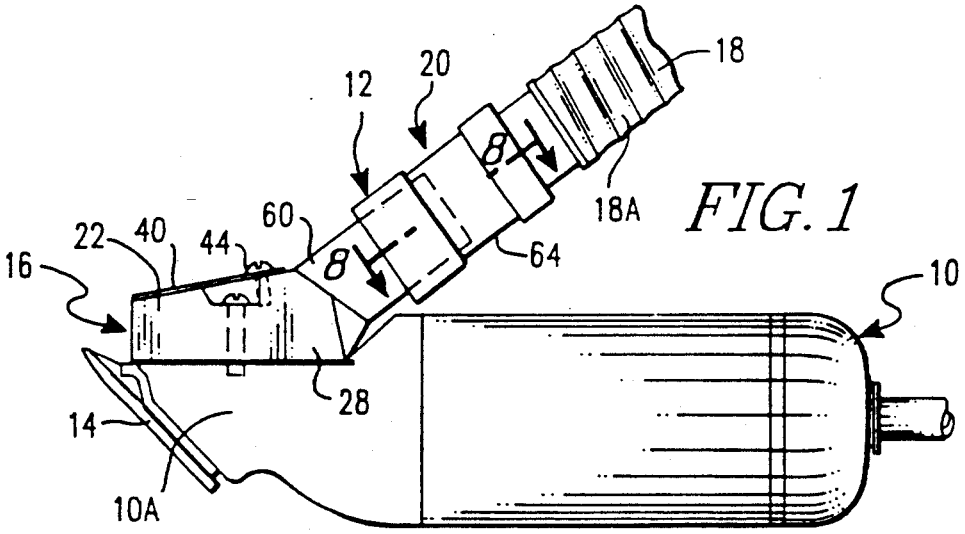
FIG. 1 is a side elevational view of a conventional hand-held hair clipper and a vacuum attachment mounted on the clipper, illustrating one feature of the present invention incorporated by the attachment.
Figure 2:
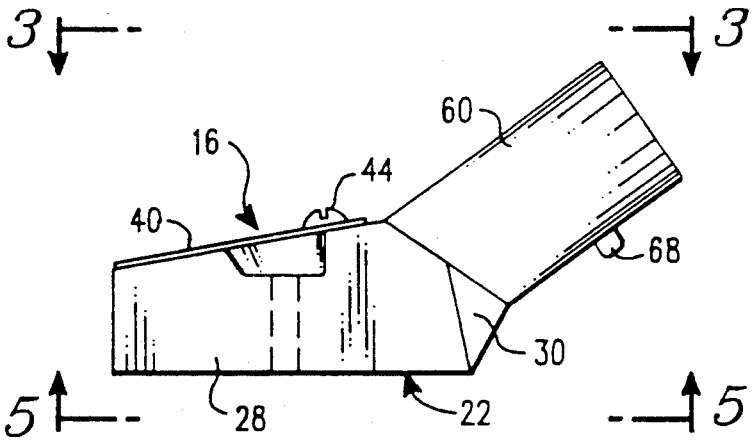
FIG. 2 is an enlarged side elevational view of the vacuum attachment removed from the clipper.

In the following description, like reference characters designate like or corresponding parts throughout the several views of the drawings. Also in the following description, it is to be understood that such terms as "forward", "rearward", "left", "right", "upwardly", "downwardly", and the like, are words of convenience and are not to be construed as limiting terms.

Referring now to the drawings, and particularly to FIG. 1, there is illustrated a conventional hand-held electric hair grooming clipper 10 and a vacuum attachment 12 in accordance with the present invention. The vacuum attachment 12 is mounted on a cutting head end 10A of the clipper 10 which has the clipper cutting blades 14 thereon. The vacuum attachment 12 includes a vacuum or suction head 16, a hose 18 which leads to a source of vacuum (not shown), and a hollow coupler 20 which releasably connects the suction head 16 in communication with an end 18A of the hose 18.

Figure 3:
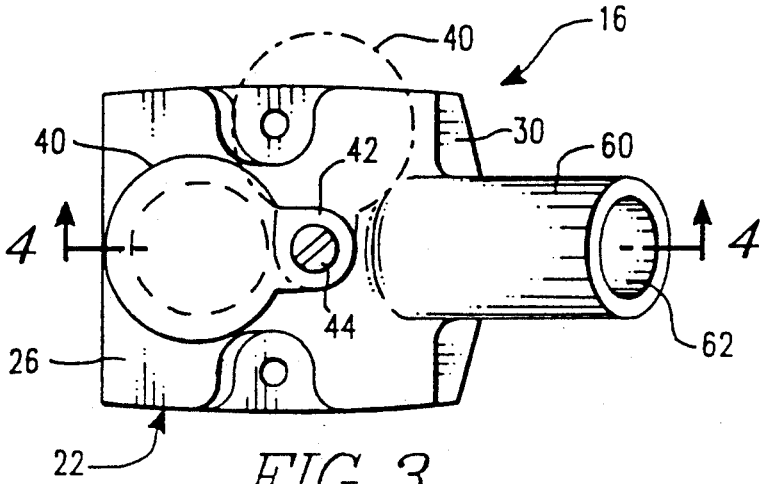
FIG. 3 is a top plan view of the vacuum attachment as seen along line 3—3 of FIG. 2.
Figure 4:
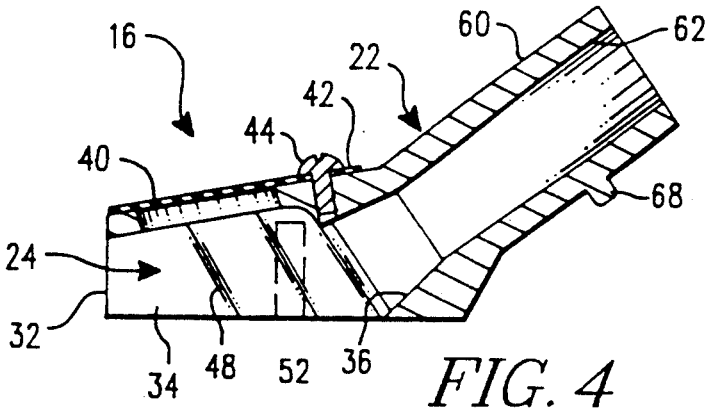
FIG. 4 is a longitudinal sectional view of the vacuum attachment taken along line 4—4 of FIG. 3.
Figure 5:
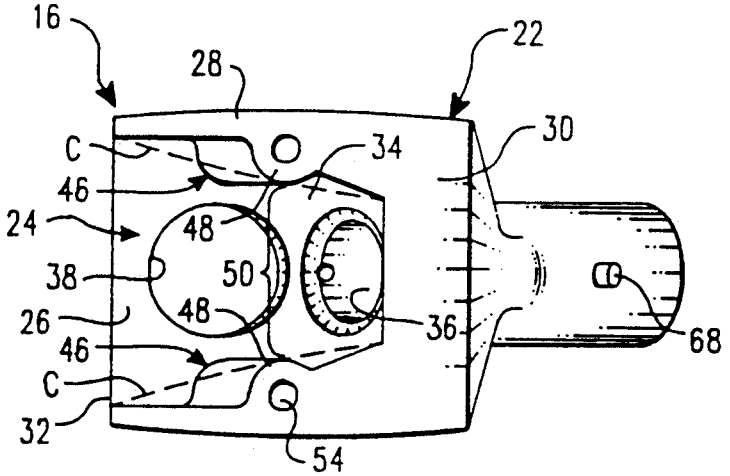
FIG. 5 is a bottom plan view of the vacuum attachment as seen along line 5—5 of FIG. 2, illustrating another feature of the present invention incorporated by the attachment.

Referring to FIGS. 1-5, more particularly, the suction head 16 has a body 22 with an air flow passage 24 defined by a top wall 26, a pair of side walls 28, and a rear wall 30. The side walls 28 extend downward from opposite lateral edges of the top wall 26 to define a front inlet 32. The rear wall 30 extends downward from a rear edge of the top wall 26 and between and interconnects with the side walls 28 at their rearward ends to define an open bottom 34 (FIG. 5). Also, a rear outlet 36 is defined through the rear wall 30 being substantially smaller in cross-sectional area than the front inlet 32.

When the suction head 16 is installed on the cutting head end 10A of the clipper 10, the clipper 10 closes the open bottom 34 of the suction head body 22. A vacuum applied to the suction head 16 through the vacuum hose 18 will now induce a flow of air through the air flow passage 24 from the front inlet 32 to the rear outlet 36 of the suction head body 22 and therefrom through the hollow coupler 20 to the vacuum hose 18. It can be readily understood that as hair is cut by the clipper 10, the loose hair cuttings will be sucked into the suction head 12 through its front inlet 32 located immediately rearward of the cutting blades 14. The hair cuttings will be entrained in the flow of air travelling rearward through the air flow passage 24 to the vacuum hose 18. Although not shown, as well-known in the art, the hair cuttings will be deposited from the vacuum hose 18 into a collection container.

For performing different lengths and styles of hair cuts on dogs, it is desirable to be able to easily and frequently vary the amount of vacuum applied through the suction head 16. By provision of one feature of the present invention the regulation of the vacuum condition within the suction head 16 can be easily and readily accomplished. This feature is a vacuum relief port in the form of a circular hole 38 defined in the suction head 16 and a flexible flat sealing lid 40 attached on the head 16 for covering the port 38. The relief port 38 is defined through the top wall 26 of the suction head 16 intermediate between the inlet 32 and outlet 36 of the air flow passage 24 for providing communication between the passage 24 and the exterior of the suction head 16. The flexible sealing lid 40 is a circular disc-like flap attached at only a peripheral tab 42 protruding from one location of its periphery to the top wall 26 by a fastener 44 adjacent to the relief port 38 (FIG. 3).

When the lid 40 overlies the relief port 38, the vacuum condition within the passage 24 draws the lid 40 toward the port 38 into a sealing relation against the peripheral edge of the port 38. However, by pushing on the edge of the lid 40 with a finger, a user can readily slidably move the lid 40 relative to the fastener 44 and port 38 for varying the amount of area of the port 38 closed by the lid 40 and thereby for regulating the degree of relief provided by the port 38 of the vacuum condition applied through the suction head 16.

By provision of another feature of the present invention improved air flow and suction is obtained through the suction head 16, as best seen in FIG. 5. This feature relates to the configuration of the internal air flow passage 24 within the suction head 16. A flow constriction 46 in the form of a pair of inclined rounded shoulders 48 are defined midway through the air flow passage 24 projecting into the passage from the interiors of the opposite side walls 28 of the body 22. The shoulders 48 are defined midway between the opposite inlet 32 and outlet 36 of the passage 24 and proximate the location of the relief port 38. The space or region 50 defined between the shoulders 48 is the narrowest point between the opposite side walls 28. Thus, the region 50 is where the air pressure is highest and air velocity is lowest. The converging lines C shown in FIG. 5 represent the interior surfaces of the side walls of a prior art suction head body and readily demonstrate that the air pressure was highest and air velocity lowest at the location of the outlet and not at a location intermediate between the inlet 32 and outlet 36 as in the present invention.

Advantageously, the regulation of relief of the vacuum condition within the suction head 16 which is accomplished by varying the amount of the closed area of the port 38 occurs at the region 50 of the passage 24 where the air pressure is highest and air velocity is lowest. Fasteners 52 in the form of screws, as seen in FIGS. 1 and 4, are inserted through bores 54 defined through the shoulders 48 for installing by detachably attaching the suction head 16 onto the clipper 10.

In view that the port 38 is located adjacent to the region 50 of the internal air flow passage 24 through the suction head 16 where the air pressure is highest and air velocity is lowest, when the port 38 is completely opened by pivoting of the sealing lid 40 to one side there is a tendency for any long hair settling at the port 38 from the surrounding atmosphere external to the suction head 16 to clop the port 38 since the velocity of internal air flow in the passage past the port 38 is not sufficiently great to entrain and carry the hair away quickly enough to prevent accumulation of such long hair.

Figure 6:
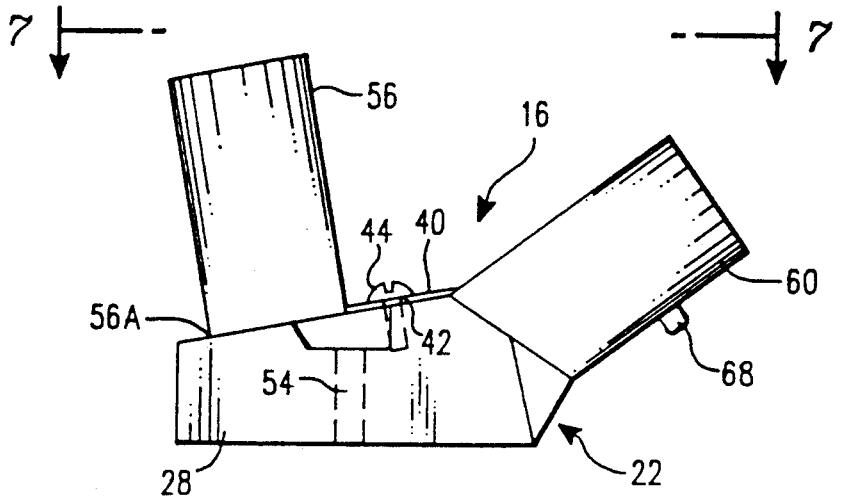
FIG. 6 is a side elevational view similar to that of FIG. 2, illustrating still another feature of the present invention incorporated by the attachment.
Figure 7:
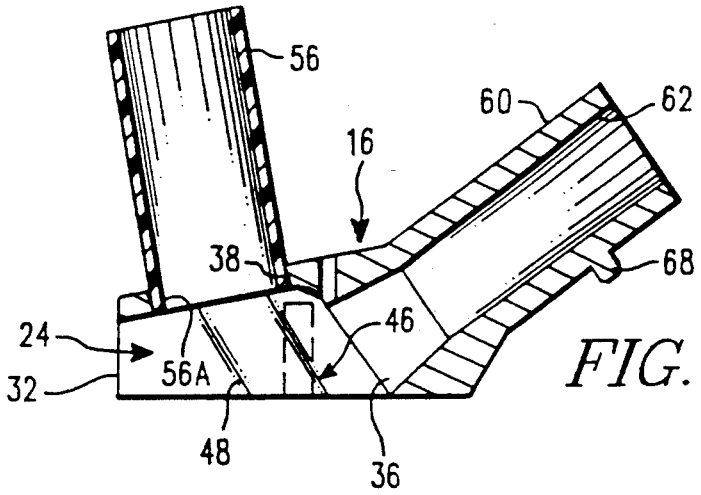
FIG. 7 is a longitudinal sectional view of the vacuum attachment taken along line 7—7 of FIG. 6.

By provision of still another feature of the present invention clogging of the relief port 38 is avoided when the port 38 is completely open with the lid 40 being offset to one side of the port 38, being shown in dotted line form in FIG. 3. Referring to FIGS. 6 and 7, this feature is a hollow tubular extension 56 removably installed in the relief port 38. The hollow tubular extension 56 has opposite lower and upper ends 56A, 56B with lower outlet and upper inlet openings 58A, 58B defined at the respective opposite ends 56A, 56B. Due to the presence of the extension 56, when the port 38 is open it will not become clogged from long hair attempting to enter it from the exterior of the suction head 16 due to the upper inlet opening 58B of the extension 56 being displaced remote from the port 38 of the suction head 16. The hollow extension 56 is preferably in the form of a flexible plastic tube which can be inserted at the love end 56A into the port 38 and retained therein merely by a friction fit.

Figure 8:
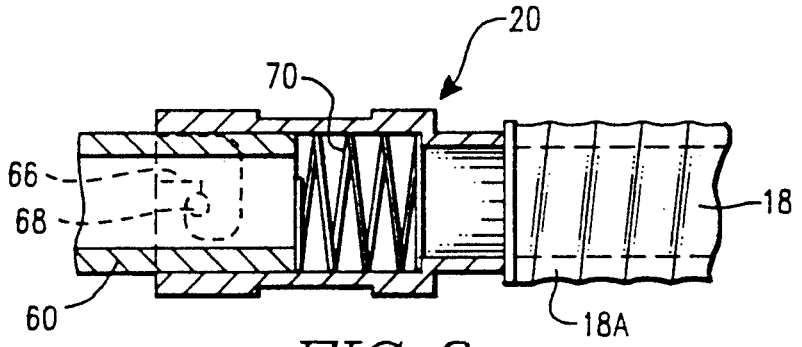
FIG. 8 is an enlarged longitudinal sectional view of a coupler of the vacuum attachment taken along line 8—8 of FIG. 1, illustrating a spring of the assembly in a contracted state.
Figure 9:
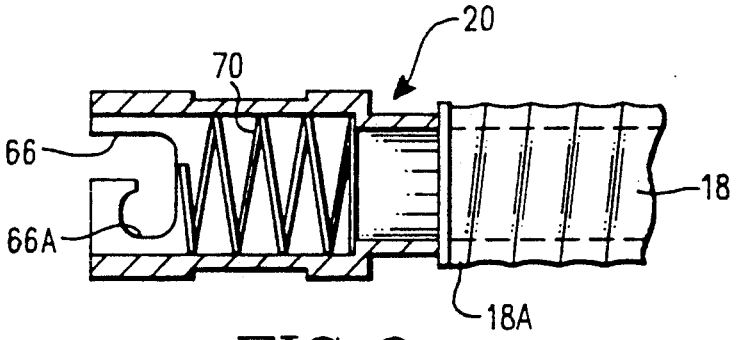
FIG. 9 is another view similar to that of FIG. 8, but with the coupler being disconnected from the vacuum attachment and illustrating the spring of the assembly in an extended state.
Figure 10:
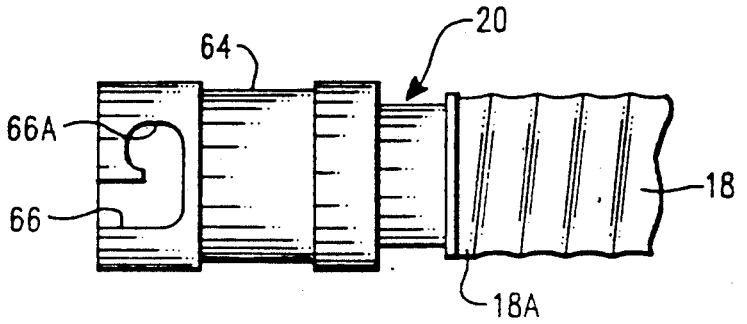
FIG. 10 is a plan view of the coupler seen in FIG. 9, but rotated 180 degrees.

FIGS. 8-10 illustrate the coupler 20 of the vacuum attachment 12 for attaching the hose 18 to a connector tube 60 integrally formed on the suction head 16 and defining a bore 62 leading from the outlet 36. The coupler 20 includes a tubular member 64 having an L-shaped notch 66 defined therein which receives a nipple 68 defined on and protruding outwardly from the connector tube 60. The coupler 20 also includes a coil spring 70 which abuts between an internal shoulder 64A of the tubular member 64 and the end of the connector tube 60 and biases the member 64 away from the tube 60 so as to maintain the nipple 68 within the elbow end 66A of the notch 66. The spring 70 is shown in a contracted state in FIG. 8 wherein the connector tube 60 is connected to the tubular member 64 and in an extended state in FIG. 9 wherein the connector tube 60 is disconnected from the tubular member 64.

It is thought that the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

I claim:

1. A vacuum attachment for a hair grooming clipper, comprising:

(a) a suction head having a body defining an internal air flow passage and an inlet to and outlet from said passage;

(b) a vacuum relief port defined through said suction head body intermediate between said inlet and outlet of said air flow passage for providing communication between said passage and the exterior of said suction head; and (c) a closure in the form of a flexible sealing lid attached to the exterior and disposed on the exterior of said body so as to overlie said relief port and being movable for varying the amount of area of said port closed by said closure and thereby regulating the degree of relief through said port of a vacuum condition within said internal passage of said suction head.

2. The vacuum attachment as recited in claim 1, wherein said closure is a flexible flat sealing lid having a protruding tab at which said lid is attached to said suction head body.

3. The vacuum attachment as recited in claim 1, wherein said body of said suction head includes a top wall, a pair of side walls extending downward from opposite lateral edges of said top wall to define said inlet to said flow passage, and a rear wall extending downward from a rear edge of said top wall and between and interconnecting said side walls at rearward ends thereof to define an open bottom to said flow passage which is closed by installation of said suction head upon the hair grooming clipper, said rear wall having defined therein said outlet from said flow passage.

4. The vacuum attachment as recited in claim 3, wherein said suction head has a flow constriction defined on the side walls thereof and projecting into said air flow passage midway between said opposite inlet and outlet and proximate said relief port such that regulation of relief of the vacuum condition can occur at the region of the passage where the air pressure is highest and air velocity is lowest.

5. The vacuum attachment as recited in claim 3, wherein said flexible sealing lid is attached to said top wall adjacent to said port and is movable between a closed position in which said lid overlies said port and an opened position in which said lid is offset to one side of said port.

6. The vacuum attachment as recited in claim 5, further comprising:

a hollow tubular extension having opposite upper and lower ends and opposite upper inlet and lower outlet openings defined at said respective opposite ends, said tubular extension at said lower end being applied in said relief port when said lid is at said opened position such that said upper inlet opening of said extension is displaced remote from said open port to prevent clogging of said open port by long hair in the external atmosphere entering said port from the exterior of said suction head.

7. The vacuum attachment as recited in claim 6, wherein said tubular extension is a flexible plastic tube insertable at one end into said relief port and retained therein by a frictional fit.

8. A suction attachment for a hair grooming clipper, comprising:

(a) a suction head having an internal air flow passage defined by a top wall, a pair of side walls extending downward from opposite lateral edges of said top wall to define an inlet to said flow passage, and a rear wall extending downward from a rear edge of said top wall and between and interconnecting said side walls at rearward ends thereof to define an open bottom to said flow passage which is closed by installation of said suction head upon the hair grooming clipper, said rear wall having defined therein an outlet from said flow passage;

(b) a vacuum relief port defined through said top wall of said suction head intermediate between said inlet and outlet of said air flow passage for providing communication between said passage and the exterior of said suction head; and (c) a flexible sealing lid attached on the exterior of said top wall adjacent said port and being movable for varying the amount of area of said port closed by said lid and thereby regulating the degree of relief provided at said port of the vacuum condition applied through the suction head.

9. The vacuum attachment as recited in claim 8, wherein said suction head has a flow constriction defined on the side walls thereof and projecting into said air flow passage midway between said opposite inlet and outlet and proximate said relief port such that regulation of relief of the vacuum condition can occur at the region of the passage where the air pressure is highest and air velocity is lowest.

10. The vacuum attachment as recited in claim 8, further comprising:

a hollow tubular extension having opposite upper and lower ends and opposite upper inlet and lower outlet openings defined at said respective opposite ends, said tubular extension at said lower end being applied in said relief port when said lid is at said opened position such that said upper inlet opening of said extension is displaced remote from said open port to prevent clogging of said open port by long hair in the external atmosphere entering said port from the exterior of said suction head.

11. The vacuum attachment as recited in claim 10, wherein said tubular extension is a flexible plastic tube insertable at one end into said relief port and retained therein by a frictional fit.

12. A vacuum attachment for a hair grooming clipper, comprising:

(a) a suction head having an internal air flow passage defined by a top wall, a pair of side walls extending downward from opposite lateral edges of said top wall to define an inlet to said flow passage, and a rear wall extending downward from a rear edge of said top wall and between and interconnecting said side walls at rearward ends thereof to define an open bottom to said flow passage which is closed by application of said suction head upon the hair grooming clipper, said rear wall having defined therein an outlet from said flow passage; and (b) a flow constriction defined on the interior of said side walls of said suction head and projecting into said air flow passage midway between and spaced from said inlet and outlet, said flow constriction defining a region of said passage being the narrowest point between said opposite side walls and where the air pressure is highest and air velocity is lowest.

* * * * *